US006360718B1

(12) United States Patent
Wicker

(10) Patent No.: US 6,360,718 B1
(45) Date of Patent: Mar. 26, 2002

(54) LOAD SETTING DEVICE

(75) Inventor: Herbert Wicker, Kelkheim (DE)

(73) Assignee: Mannesmann VDO AG (DE)

( * ) Notice: Subject to any disclaimer, the term of this patent is extended or adjusted under 35 U.S.C. 154(b) by 0 days.

(21) Appl. No.: 09/486,213

(22) PCT Filed: Aug. 13, 1998

(86) PCT No.: PCT/EP98/05148

§ 371 Date: May 30, 2000

§ 102(e) Date: May 30, 2000

(87) PCT Pub. No.: WO99/10642

PCT Pub. Date: Mar. 4, 1999

(30) Foreign Application Priority Data

Aug. 22, 1997 (DE) ..... 197 36 521

(51) Int. Cl.[7] ..... F02D 9/02; F02D 11/10
(52) U.S. Cl. ..... 123/396; 123/399
(58) Field of Search ..... 123/361, 396, 123/397, 399

(56) References Cited

U.S. PATENT DOCUMENTS 5,492,097 A 2/1996 Byram et al. ..... 123/396
5,775,292 A * 7/1998 Seeger ..... 12/396

FOREIGN PATENT DOCUMENTS

WO 9737116 10/1997

* cited by examiner

*Primary Examiner*—Tony M. Argenbright

(57) ABSTRACT

A load adjustment apparatus for a final control element (4) which determines the power of an internal combustion engine and is arranged on an actuating shaft (2) has a torsion spring (18) which is stressed by a minimum-load gear between a minimum-load position and an emergency-running position and is stressed by an actuating gear (5) between a full-load position and the emergency-running position. The minimum-load gear has a dog (10) which can be pivoted in the same sense as a gearwheel (9) arranged on an intermediate gearwheel (8) and serves to take along one end (12) of the torsion spring (18), the end resting against a stop (13) in the emergency-running position. The torsion spring (18) loads the actuating part (4) and hence the actuating shaft (2) continuously into the emergency-running position.

8 Claims, 2 Drawing Sheets

LOAD SETTING DEVICE

FIELD AND BACKGROUND OF THE INVENTION

The invention relates to a load adjustment apparatus for a final control element which determines the power of an internal combustion engine, is designed, in particular, as a throttle valve and is arranged on an actuating shaft, in which arrangement the actuating shaft can be driven so as to be pivotable between a minimum-load position and a full-load position by way of an actuating part, connected to it in a rotationally fixed position, by means of a reversible actuating gear, having a preloaded return spring which is designed as a torsion spring and acts on the actuating shaft in the minimum-load direction, and having an emergency-running spring by means of which the actuating shaft can be moved in the full-load direction as far as an emergency-running position.

Load adjustment apparatuses of the type mentioned above are well known under the name E-Gas and are used to adjust power of the internal combustion engine of motor vehicles. To minimize fuel consumption, the minimum-load position in these apparatuses is designed in such a way that, in it, the internal combustion engine only just continues to run smoothly at idling speed. As a result, it is not possible in the minimum-load position to produce sufficient torque to move the motor vehicle. However, this may be necessary if there is a need to drive the motor vehicle out of a danger zone but the load adjustment apparatus can no longer be adjusted by actuating the accelerator pedal owing to failure of the control electronics or of the actuating gear. In the known load adjustment apparatuses, therefore, there is, in addition to the return spring, an emergency-running spring which ensures that if the control electronics or the actuating gear fails the final control element necessarily moves out of the minimum-load position into an emergency-running position, in which the internal combustion engine produces a sufficiently high torque to move the motor vehicle at low speed. This emergency-running position is defined by a stop which can be displaced against the force of the return spring, against which the actuating part is loaded by means of the emergency-running spring and which can be displaced against the force of the return spring by the actuating part when the actuating part moves out of the emergency-running position in the direction of the full-load position.

Apart from the costs involved, the emergency-running spring required to obtain the emergency-running position requires a corresponding installation space and leads to an increase in weight in comparison with a load adjustment apparatus without enforced movement into an emergency-running position in the event of a defect.

SUMMARY OF THE INVENTION

The problem underlying the invention is to provide a load adjustment apparatus of the type stated at the outset in such a way that it is as compact as possible in construction and can be produced at reasonable cost.

According to the invention, this problem is solved wherein the return spring and the emergency-running spring are formed by a single torsion spring, the first end of which is connected to the actuating shaft and the other end of which can be moved against the force of the torsion spring between the emergency-running position and the minimum-load position by means of a minimum-load gear coupled to the actuating gear.

By this formation, the single torsion spring is used both as a return spring and as an emergency-running spring and, depending on the actuating angle of the actuating shaft, is stressed either directly by way of the actuating gear or the minimum-load gear coupled to the actuating gear. The actuating shaft thus pivots automatically into the emergency-running position from any position when there are no forces acting on the actuating gear. The elimination of one of the springs makes the load adjustment apparatus according to the invention particularly compact in design and it can therefore be produced at very reasonable cost. Apart from the actuating gear, the only other thing that the load adjustment apparatus according to the invention requires is a minimum-load gear of particularly simple construction.

The preloading of the torsion spring by the minimum-load gear could, for example, be accomplished by securing the second end of the torsion spring on a holding part which is adjustable by the minimum-load gear. However, according to an advantageous development of the invention, the preloading of the torsion spring by the minimum-load gear requires a particularly low level of expenditure in terms of construction if between the emergency-running position and the full-load position, the second end of the torsion spring rests against a stop and, between the emergency-running position and the minimum-load position, can be moved away from the stop.

According to another advantageous development of the invention, the actuating gear can be arranged in a space-saving manner in the load adjustment apparatus if the actuating part has a segment gear designed to mesh with a gearwheel of the actuating gear.

According to another advantageous development of the invention, the actuating gear has a particularly small overall height if the actuating gear has a large-diameter intermediate gearwheel which is driven by a drive pinion and is connected coaxially and in a rotationally fixed position to a small-diameter gearwheel which pivots the actuating part. This configuration furthermore has the advantage that the actuating shaft is pivoted by the actuating gear if the torsion spring breaks. A defect in a single component of the load adjustment apparatus according to the therefore does not lead to complete failure of the internal combustion engine controlled by it.

According to another advantageous development of the invention, the minimum-load gear requires a particularly low level of expenditure in terms of construction if a dog for moving the second end of the torsion spring is arranged on the intermediate gearwheel. Here, the dog can be designed in a wide variety of different ways. For example, the dog can be designed as a peg manufactured in one piece with the intermediate gearwheel or be formed by a freely rotatable roller.

According to another advantageous development of the invention, the torsion spring takes up a particularly small amount of space if it is a spiral spring. If particularly high reliability against breakage of the spring is required, two identical spiral springs arranged one above the other can simply be used as the torsion spring.

According to another advantageous development of the invention, the torsion spring can be held reliably in its position if a guiding part resting laterally against the torsion spring is secured in the housing supporting the intermediate gearwheel.

According to another advantageous development of the invention, limiting the actuating range of the actuating shaft requires a particularly low level of expenditure in terms of construction if a stop plate which comes up against stops fixed relative to the housing in the minimum-load position and in the full-load position is secured in a rotationally fixed position on the actuating shaft. The stops can, of course, be designed to be adjustable to enable an idle setting or a full-load limit to be set.

Manufacturing the actuating part and the stop plate in one piece contributes to a further reduction in the manufacturing costs of the load adjustment apparatus according to the invention.

BRIEF DESCRIPTION OF THE DRAWINGS

The invention allows of numerous embodiments. To further illustrate the basic principle, one of these is shown in the drawings and is described below.

In the drawings.

DETAILED DESCRIPTION OF THE PREFERRED EMBODIMENT

Figure 1:
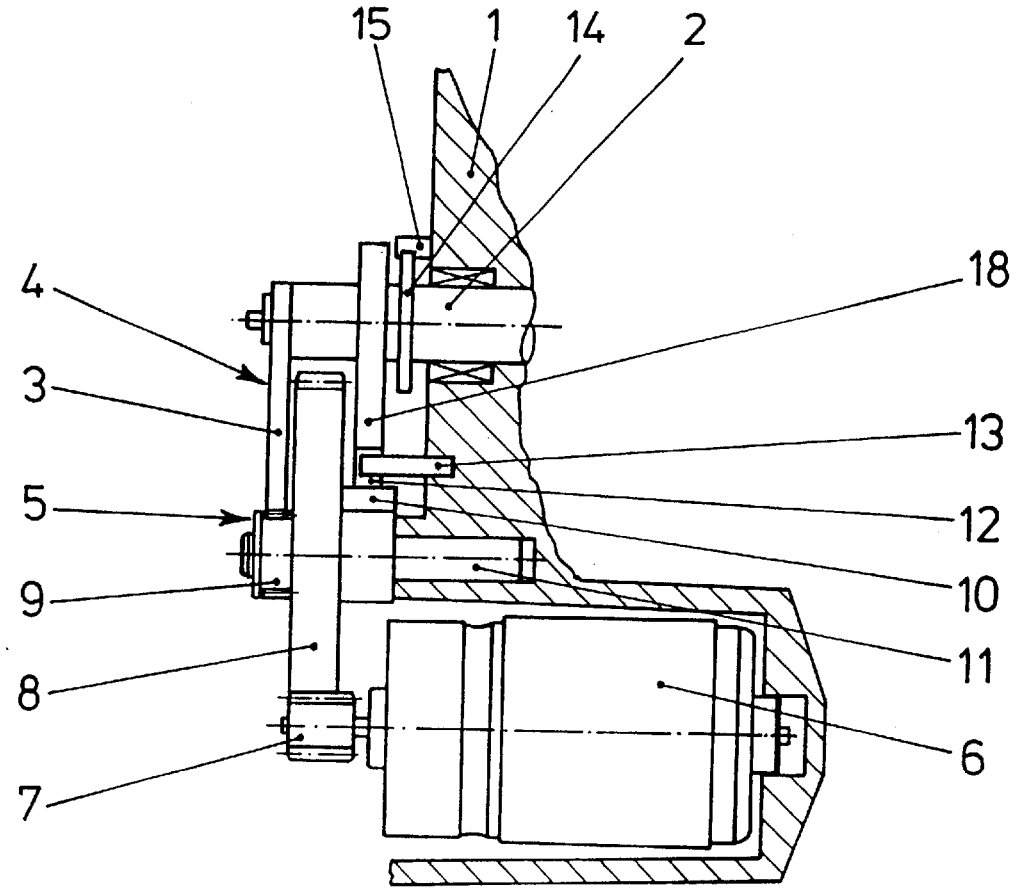
FIG. 1 shows a section through a load adjustment apparatus according to the invention.

FIG. 1 shows a partial area of a housing 1 of a throttle body. Mounted in the housing 1 is an actuating shaft 2, which can be a throttle valve shaft on which a throttle valve (not shown) is arranged. Seated on the actuating shaft 2 in a rotationally fixed position is an actuating part 4, which has a segment gear 3 and can be pivoted by means of an actuating gear 5.

The actuating gear 5 has an actuating motor 6, which drives a large-diameter intermediate gearwheel 8 via a drive pinion 7. This intermediate gearwheel 8 is manufactured in one piece with a small-diameter gearwheel 9 and a radially projecting dog 10 and is mounted on a spindle 11. The actuating part 4 having the segment gear 3 is in continuous engagement with the gearwheel 9 arranged on the intermediate gearwheel 8. The throttle body furthermore has a torsion spring 18, which is secured at one end on the actuating shaft 2 and rests by its other end 12 against a stop 13 fixed relative to the housing. Arranged on the actuating shaft 2 in a rotationally fixed position there is furthermore a stop plate 14. In the region of the stop plate 14, the housing 1 has a stop 15.

Figure 2:
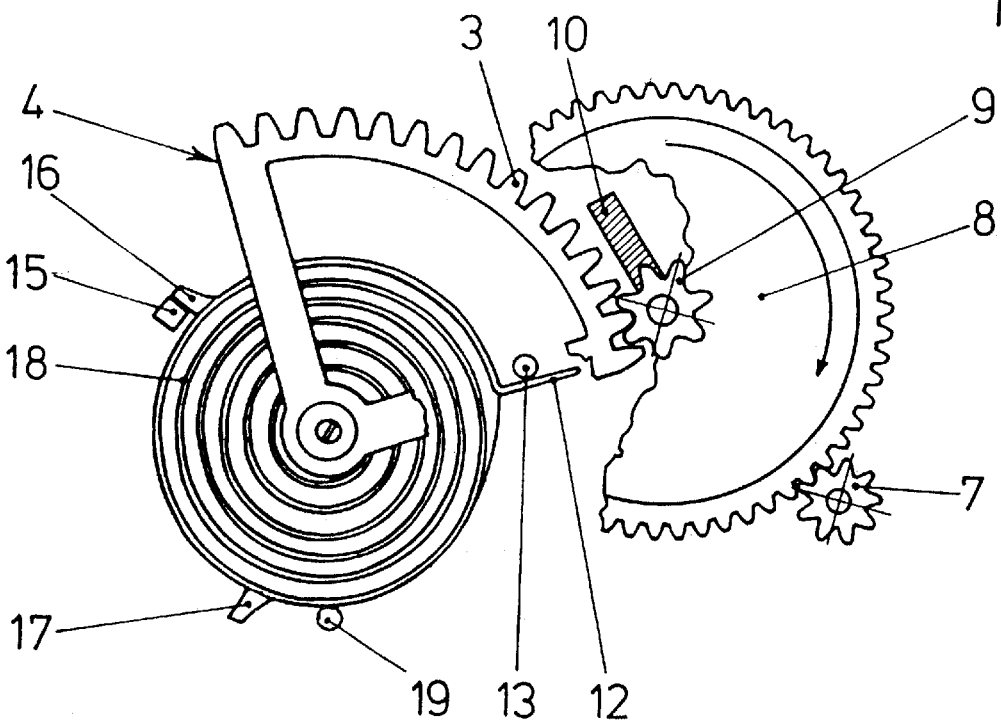
FIG. 2 shows a partially sectioned side view of the load adjustment apparatus in FIG. 1 in the full-load position.
Figure 3:
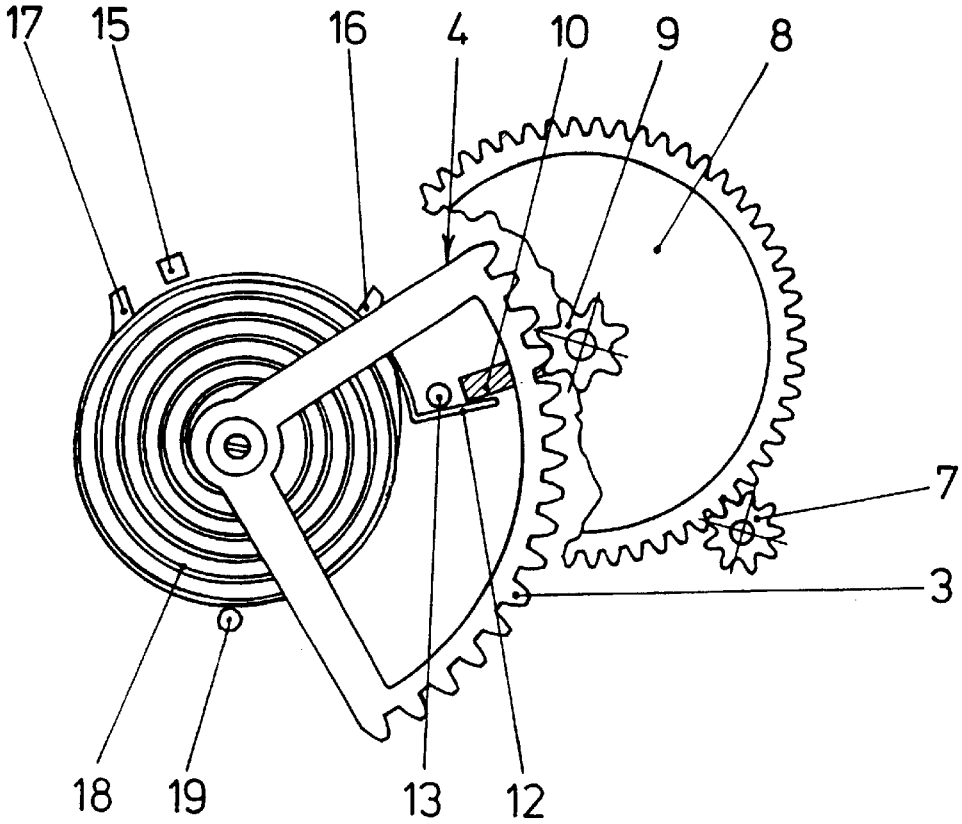
FIG. 3 shows a partially sectioned side view of the load adjustment apparatus in FIG. 1 in the emergency-running position.
Figure 4:
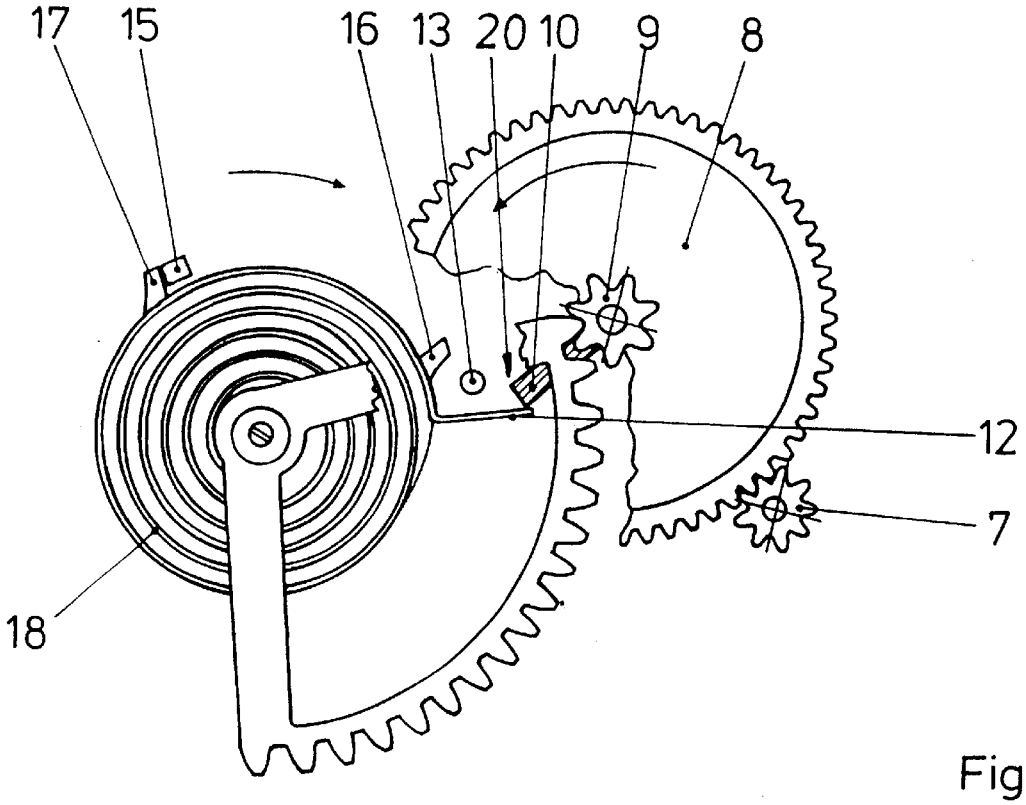
FIG. 4 shows a partially sectioned side view of the load adjustment apparatus in FIG. 1 in the minimum-load position.

FIGS. 2 to 4 show the mode of operation of the throttle body in FIG. 1 in a view from above in various positions. It can be seen here that the stop plate 14 has a full-load arm 16 and a minimum-load arm 17. The second end 12 of the torsion spring 18 is angled and projects beyond the stop 13 into the path of motion of the dog 10 arranged on the intermediate gearwheel 8. A guiding part 19 designed as a pin is furthermore integrated into the housing 1 of the throttle body (in particular pressed into it, secured on it or formed by the housing 1 itself), and this guiding part holds the torsion spring 18 in a lateral region. Given appropriate configuration of the stop plate 14, this guiding part 19 can also be used as a stop for the minimum-load position.

FIG. 2 shows the load adjustment apparatus in the full-load position. To reach the full-load position, the intermediate gearwheel 8 is deflected clockwise by means of the actuating motor 6 shown in FIG. 1. As a result, the gearwheel 9 of the actuating gear 5 pivots the segment gear 3 of the actuating part 4 counterclockwise until the full-load arm 16 of the stop plate 14 comes up against the stop 15 of the housing 1. Since the actuating part 4 and one end of the torsion spring 18 are connected to the actuating shaft 2 in a rotationally fixed position, the actuating shaft 2 is deflected and the torsion spring 18 is stressed. The second end 12 of the torsion spring 18 here rests against the stop 13.

If, due to a defect for example, the actuating motor 6 shown in FIG. 1 is no longer energized, the actuating shaft 2 and hence the actuating part 4 and the intermediate gearwheel 8 are pivoted back by the force of the torsion spring 18 until the dog 10 arranged on the intermediate gearwheel 8 comes up against the second end 12 of the torsion spring 18. This position defines the emergency-running position, which is shown in FIG. 3. This emergency-running position is distinguished by the fact that neither the minimum-load arm 17 nor the full-load arm 16 of the stop plate 14 rest against the stop 15 fixed relative to the housing.

FIG. 4 shows the throttle body in the minimum-load position, in which the minimum-load arm 17 of the stop plate 14 rests against the stop 15 fixed relative to the housing. This minimum-load position is reached from the emergency-running position when the drive pinion 7 of the actuating motor 6 shown in FIG. 1 adjusts the intermediate gearwheel 8 counterclockwise. The actuating shaft 2 is thereby deflected by way of the actuating gear 5. At the same time, the dog 10 raises the second end 12 of the torsion spring 18 from the stop 13. The dog 10 and the second end 12 of the torsion spring 18 thus form a minimum-load gear 20. When the actuating motor 6 is no longer energized, the second end 12 of the torsion spring 18 moves the dog 10 into the emergency-running position shown in FIG. 3. The emergency-running position is therefore necessarily reached by virtue of the force of the torsion spring 18 when the actuating motor 6 shown in FIG. 1 is no longer energized.

What is claimed is:

1. A load adjustment apparatus for a final control element which determines the power of an internal combustion engine, is designed, in particular, as a throttle valve and is arranged on an actuating shaft, in which arrangement the actuating shaft can be driven so as to be pivotable between a minimum-load position and a full-load position by an actuating part, connected thereto in a rotationally fixed position, by a reversible actuating gear, having a preloaded return spring which is formed as a torsion spring and acts on the actuating shaft in minimum-load direction, and having an emergency-running spring by which the actuating shaft can be moved in the full-load direction as far as an emergency-running position, wherein the return spring and the emergency-running spring are formed by a single torsion spring (18), a first end thereof being connected to the actuating shaft (2) and a second end (12) thereof is moved against force of the torsion spring (18) between the emergency-running position and the minimum-load position by a minimum-load gear (20) coupled to the actuating gear (5), wherein, between the emergency-running position and the full-load position, the second end (12) of the torsion spring (18) rests against a stop (13) and, between the emergency-running position and the minimum-load position, is moved away from the stop (13).

2. The load adjustment apparatus as claimed in claim 1, wherein the actuating part (4) has a segment gear (3) formed to mesh with a gearwheel (9) of the actuating gear (5).

3. The load adjustment apparatus as claimed in claim 1, wherein the actuating gear (5) has a large-diameter intermediate gearwheel (8) which is driven by a drive pinion (7) and is connected coaxially and in a rotationally fixed position to a small-diameter gearwheel (9) which pivots the actuating part (4).

4. The load adjustment apparatus as claimed in claim 1, wherein a dog (10) for moving the second end (12) of the torsion spring (18) is arranged on an intermediate gearwheel (8).

5. The load adjustment apparatus as claimed in claim 1, wherein said torsion spring (18) is a spiral spring.

6. The load adjustment apparatus as claimed in claim 1, wherein a guiding part (19) resting laterally against the torsion spring is secured in a housing (1) supporting an intermediate gearwheel (8).

7. A load adjustment apparatus for a final control element which determines the power of an internal combustion engine, is designed, in particular, as a throttle valve and is arranged on an actuating shaft, in which arrangement the actuating shaft can be driven so as to be pivotable between a minimum-load position and a full-load position by an actuating part, connected thereto in a rotationally fixed position, by a reversible actuating gear, having a preloaded return spring which is formed as a torsion spring and acts on the actuating shaft in minimum-load direction, and having an emergency-running spring by which the actuating shaft can be moved in the full-load direction as far as an emergency-running position, wherein the return spring and the emergency-running spring are formed by a single torsion spring (18), a first end thereof being connected to the actuating shaft (2) and a second end (12) thereof is moved against force of the torsion spring (18) between the emergency-running position and the minimum-load position by a minimum-load gear (20) coupled to the actuating gear (5), wherein a stop plate (14) which comes up against stops (15) fixed relative to a housing in the minimum-load position and in the full-load position is secured in a rotationally fixed position on the actuating shaft (2).

8. A load adjustment apparatus for a final control element which determines the power of an internal combustion engine, is designed, in particular, as a throttle valve and is arranged on an actuating shaft, in which arrangement the actuating shaft can be driven so as to be pivotable between a minimum-load position and a full-load position by an actuating part, connected thereto in a rotationally fixed position, by a reversible actuating gear, having a preloaded return spring which is formed as a torsion spring and acts on the actuating shaft in minimum-load direction, and having an emergency-running spring by which the actuating shaft can be moved in the full-load direction as far as an emergency-running position, wherein the return spring and the emergency-running spring are formed by a single torsion spring (18), a first end thereof being connected to the actuating shaft (2) and a second end (12) thereof is moved against force of the torsion spring (18) between the emergency-running position and the minimum-load position by a minimum-load gear (20) coupled to the actuating gear (5), wherein the actuating part (4) and a stop plate (14) are manufactured in one piece.

* * * * *